United States Patent [19]

Cates et al.

[11] 4,181,691

[45] Jan. 1, 1980

[54] U-BAR FILL

[75] Inventors: Robert E. Cates, Arnold; Edward N. Schinner, Silver Spring, both of Md.

[73] Assignee: Baltimore Aircoil Company, Inc., Jessup, Md.

[21] Appl. No.: 960,146

[22] Filed: Nov. 13, 1978

[51] Int. Cl.[2] ..... B01F 3/04

[52] U.S. Cl. ..... 261/111; 261/112; 261/DIG. 11

[58] Field of Search ..... 261/111, 112, 97, 110, 261/113, DIG. 11, DIG. 77

[56] References Cited

U.S. PATENT DOCUMENTS

| | | | |
|---|---|---|---|
| 890,332 | 6/1908 | Burhorn | 261/DIG. 11 |
| 961,100 | 6/1910 | Burhorn | 261/DIG. 11 |
| 2,497,389 | 2/1950 | Ahrens | 261/111 |
| 3,044,237 | 7/1962 | Mart | 261/DIG. 11 |
| 3,389,895 | 6/1968 | De Flon | 261/111 |
| 3,468,521 | 9/1969 | Furlong et al. | 261/111 |
| 3,628,776 | 12/1971 | Raseley | 261/DIG. 11 |
| 3,647,191 | 3/1972 | Fordyce | 261/DIG. 11 |
| 3,758,088 | 9/1973 | Fordyce | 261/111 |
| 3,791,634 | 2/1974 | Phelps | 261/DIG. 11 |
| 3,894,127 | 7/1975 | Fordyce | 261/111 |
| 3,969,447 | 7/1976 | Glitsch et al. | 261/111 |
| 4,020,130 | 4/1977 | Ovard | 261/111 |
| 4,133,851 | 1/1979 | Ovard | 261/111 |

*Primary Examiner*—Richard L. Chiesa

*Attorney, Agent, or Firm*—Michael C. Sudol, Jr.; Harry E. Westlake, Jr.

[57] ABSTRACT

The invention relates to an improved U-shaped splash bar fill configuration for use in crossflow cooling towers.

8 Claims, 7 Drawing Figures

U-BAR FILL

BACKGROUND OF THE INVENTION

The invention relates to an improved U-shaped splash bar cooling tower fill configuration for use particularly in crossflow cooling towers, of either the mechanical draft (which is illustrated herein) or natural draft, hyperbolic type wherein the bars are disposed with their longitudinal axis parallel to air flow.

Among the problems associated with prior splash bar fill configurations and arrangements is that in most designs the splash bars are disposed with the longitudinal axis perpendicular to the direction of air flow. The large projected area in the direction of air flow created by the transverse shape and dimensions of these splash bars causes a higher resistance to air flow. Consequently the pressure drop induced in the system by the splash bars is greater than desired. Furthermore, fill splash bars designed for transverse orientation must of necessity have a low profile transverse shape thereby resulting in a part with less structural strength and stability than desired.

Typical examples of this type of fill are shown in U.S. Pat. No. 3,647,191 patented on Mar. 7, 1972, U.S Pat. No. 3,389,895 patented on June 25, 1968 and U.S. Pat. No. 3,468,521 patented on Sept. 23, 1969.

U.S. Pat. No. 3,647,191 shows M-shaped open base fill lying transverse to air flow namely lying essentially perpendicular to the air flow direction. U.S. Pat. No. 3,389,895 shows a triangular and rectangular perforate open base fill again lying transverse or perpendicular to the air flow. U.S. Pat. No. 3,468,521 shows a fill strip having an elongated edge that is convex in vertical lateral planes and an upper surface which slopes downwardly to terminate at the convex portion. Again this fill lies transverse or perpendicular to air flow.

Other splash bar fill designs which orient the members such that the longitudinal axis of said splash bar fill are parallel to the direction of air flow do not provide an effective splash surface area in the direction of water flow and do not provide the type of advantages which applicants' surface area provides. As an example, U.S. Pat. No. 3,758,088 patented on Sept. 11, 1973 shows non-planar sine-wave type fill members lying longitudinally and parallel with the air flow. This fill is made of solid sine-wave sheets having no openings therein for effective water break-up and more efficient heat transfer between water and air. Also, U.S. Pat. No. 4,020,130 patented on Apr. 26, 1977 shows a Z-bar perforated fill assembly which does not have the imperforated or structural similarities which applicants' surface provides.

SUMMARY OF THE INVENTION

This invention relates to improvements in splash bar fill for a crossflow cooling tower fill assembly. Accordingly an object of this invention is to provide a splash bar fill of a so-called U-type configuration that provides minimum resistance to air flow and that directs the air flow in the intended path parallel to the splash bar axis in a horizontal plane through the fill assembly area and which maintains improved performance, particuarly the ability to break-up the falling liquid into droplets and to impede the fall of these liquid droplets within the heat transfer or fill assembly area. A further improvement is the ability to maintain a high heat transfer efficiency when cross winds and other atmospheric disturbances are present.

Another important object of the invention is to have the majority of the surface area parallel to air flow with a minimum being transverse to air flow so that there is a minimum fan horsepower used because of the minimum resistance to air flow.

An important object of this invention is to provide a splash bar fill configuration that generates a maximum amount of liquid surface area in direct contact with air and which provides because of its particular shape several fields of different size splash areas to promote maximum air-water contact.

Another object of this invention is to provide a fill configuration which increases the time it takes for water to fall to the bottom of the tower, i.e., by increasing the retention time.

Another object of this invention is to provide a splash bar fill configuration with increased structural strength and stability such that when hanging in a holding grid the splash bar is held firmly in place and supported in all directions and which also provides increased bearing support on the lower surface.

Finally, an object of this invention is to provide a splash bar fill assembly configuration for crossflow cooling towers which is simple and economical to construct and has increased structural strength because of its shape and has a long life in the type of cooling towers described.

IN THE DRAWINGS

Figure 1:
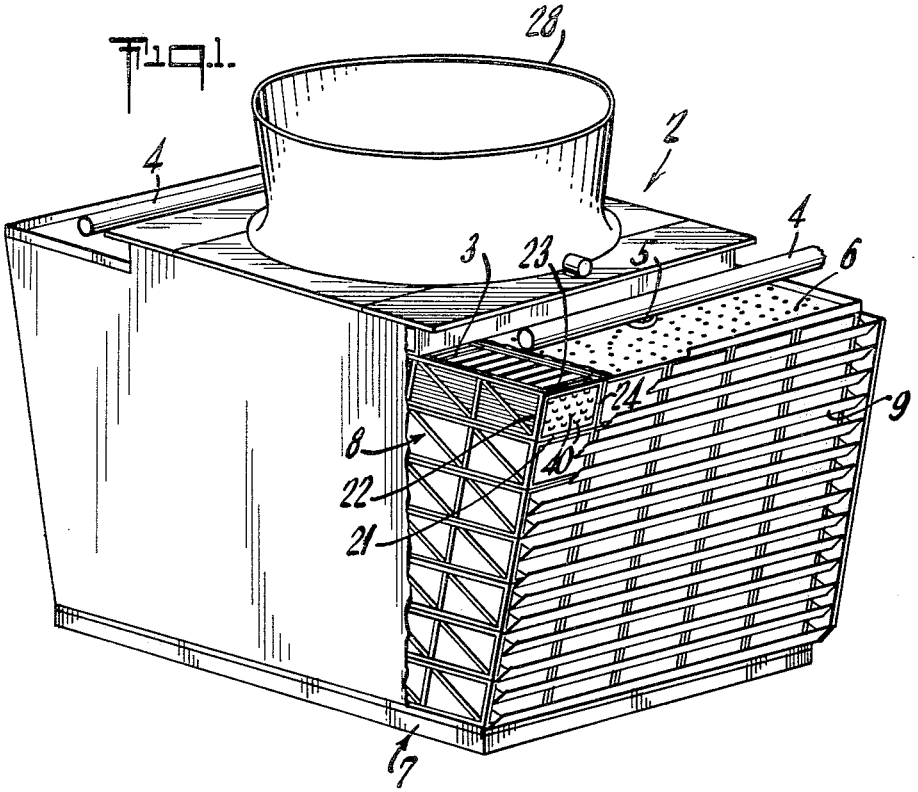
FIG. 1 is an isometric view of a typical crossflow cooling tower.

An induced draft crossflow water cooling tower 2 is illustrated in FIG. 1 having two sides enclosed and two sides open, the open sides representing the air intake area. Louvers 9 are incorporated in the air intake sides to prevent water splash from the fill assembly area shown generally as 3 and to reduce wind effects on performance. The cooling tower 2 has the usual hot water inlet 4, distributor valve 5 and hot water basin 6 having holes or other distribution means therein through which the water is dispersed into the fill assembly or heat transfer area. A cold water basin shown generally as 7 is located beneath the fill assembly 3. Mist eliminators shown generally as 8 are located behind the fill section to strip water from the moisture laden air prior to its exit from the cooling tower. Air flow is induced by a fan (which is not shown) but which draws air upwardly and outwardly through the fan cylinder 28. The fan assembly is supported by various frame members of the tower 2 and is conventional.

Figure 2:
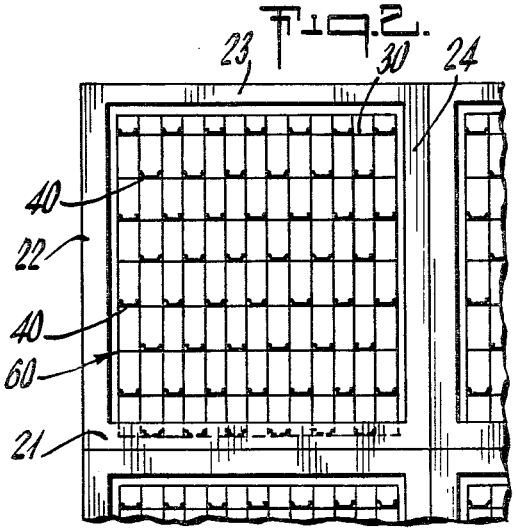
FIG. 2 is an end view of a portion of the fill assembly area showing the fill and fill hangers therein.

As shown in FIG. 2, the entire fill assembly structure 3 can be a series of frames or boxlike units having sides 24 top and bottom members 23 and 21 and longitudinal sides 22. The fill hangs in the frame as shown in FIG. 1.

Figure 3:
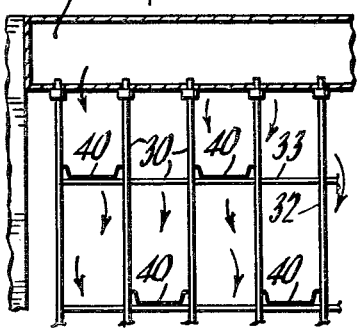
FIG. 3 is an exploded fragmentary view of the grid and fill members lying therein.

FIGS. 2 and 3 illustrate a plurality of grids shown as 30 spaced from one another in the air travel direction and disposed in vertical planes can be hung from each frame member 23. Each of these grids 30 comprise a number of horizontal elements 33 and intersecting generally vertical elements 32 to form a holding structure for the fill elements 40. The horizontal and vertical elements 33 and 32 of a grid structure are composed of either a synthetic resin material such as plastic or can be of a metal such as steel or fine drawn wire material. The metal material may be coated or encapsulated with a synthetic resin material. The grid elements can be hung from the upper frame member 23 by conventional means such as for example by J-hooks or bolts or by having the grids rest in notched members or other conventional method well known to those skilled in the art.

A plurality of splash bars 40 rest on and are supported by the horizontal elements 33 of the grid structure 30 and can be locked into place as further described by having the notches 41 along the longitudinal length of the fill pieces 40 fit into each row of vertical grid wires 32. Any number of grid structures 30 can be installed at various intervals along the length of the fill members and enough grid structures should be installed so that sufficient support is given the individual fill elements to prevent sagging. A preferred spacing is to have the fill supported by grid structures about every 24 inches (609.6 mm), with about 3 inches (76.2 mm) maximum cantilever of the louver end beyond the grid support plane.

Figure 4:
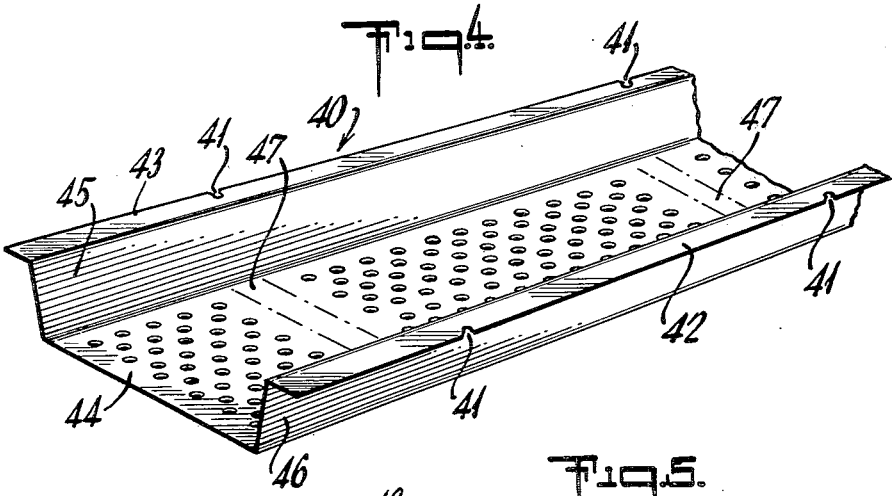
FIG. 4 is an isometric view of a longitudinal U-shaped splash bar fill member.
Figure 5:
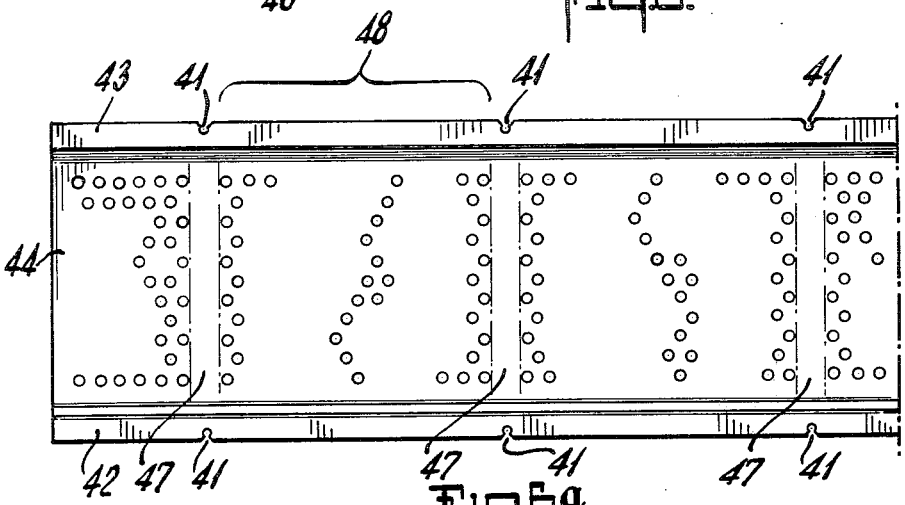
FIG. 5 is a top view of a portion of a U-shaped splash bar fill member.

A typical U-bar fill member 40 of the invention is shown in detail in FIGS. 4 and 5 where it may be seen that the splash bar 40 is elongated and is constructed with a general U-type shape cross section. As viewed in an isometric or top view of FIGS. 4 and 5, the so-called U-bar consists essentially of a series of essentially flat horizontal elements 42, 43 and 44 and a series of essentially vertical elements, 45 and 46. Thus, the U-bar fill consists of two substantially flat imperforate upper surface elements shown as 42 and 43 in FIGS. 4 and 5, a lower substantially flat partially imperforate element 44 having intermittent transverse imperforate strips 47 along its length and two vertically elongated imperforate elements 45 and 46 one each connecting each upper surface element 42 and 43 with the lower substantially flat element 44. The two upper surface elements 42 and 43 can have along their outward edges various locking elements shown as 41 which are merely notches along the outer edge of each upper surface element 42 and 43. As can be seen in FIGS. 2 and 4 these notches are aligned such that each pair of notches are directly opposite each other and fit snugly within the wire grid. This snug fit ensures that the U-bar fill will remain rigid and will not shift during operation. It may not be necessary to utilize each pair of notches along the length of the fill bar, but rather use only those which are located adjacent each grid support frame.

The lower substantially flat element of the fill 44 is perforated throughout its length except that there are interspersed solid transverse strips 47 which are imperforate. The openings on the perforated flat lower elongated strip 44 vary from $\frac{1}{8}$ inch to $\frac{1}{2}$ inch in diameter and it has been found that these openings are preferably about 3/16 in. in diameter. The size opening brings about a good liquid mechanical break-up and splashing action. Dispersed at intermittent distances along the longitudinal length of the flat lower element are strips 47 which are imperforate. In a typical size U-bar surface element, these strips are located about 5 to 7 inches (12' to 177.8 mm) from each other. The purpose of these transverse imperforated strips located along the longitudinal length of the lower surface element 44 is to ensure better air-water contact by developing a unique type splash pattern which is described further along in this specification.

At each edge of the lower element 44 there are located substantially vertical elongated elements 45 and 46 essentially perpendicular to the lower flat surface element. These strips are imperforate and provide rigidity to the U-bar splash surface as well as providing a surface wherein the water can form a film in said water downward path through the cooling tower. In addition these elements 45 and 46 offer practically no resistance to the air flow. Located on the upper edge and essentially perpendicular to these vertical elements 45 and 46 are two upper elements 42 and 43 oriented longitudinally as previously described. The upper elements 42 and 43 are also imperforate and offer practically no resistance to the air flow. They do, however, provide a flat imperforate surface upon which the water falling down through the cooling tower bounces and creates a splash pattern which ensures maximum air-water contact surface.

In a preferred embodiment of this invention, the two upper surface elements 42 and 43 have the same width which is generally in a preferred embodiment between $\frac{1}{4}$ and $\frac{3}{4}$ inches (6.35 and 19.05 mm). Similarly the width of the vertical elements 45 and 46 in a preferred embodiment are generally between $\frac{3}{4}$ and $1\frac{1}{2}$ inches (19.05 and 38.1 mm) and the width of the lower flat element 44 in a preferred embodiment is generally between 5 to 6 inches (127 to 152.4 mm). The imperforate strips 47 located intermittently along the length of the lower surface element 44 and as described is generally about 6 inches (152.4 mm) apart and are of about $\frac{1}{2}$ inch (12.7 mm) in width. Also the perforate to imperforate area ratio of the entire water encountered surface plan view areas 42, 43, 44 (which includes 47) 45 and 46 is in a preferred embodiment of approximately 33 to 67 whereas the ratio of the perforate to imperforate area of only the perforated region of lower element 44 defined as 48 in FIG. 5 is approximately 55 to 45.

Figure 6A:
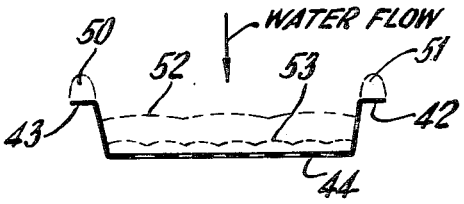
FIGS. 6A and 6B are end and side views respectively of the U-bar fill of the instant case showing typical splash patterns of the water when said fill is used in actual operation.
Figure 6B:
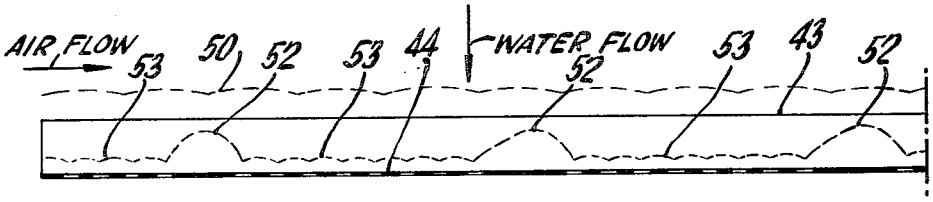

When said U-bar surface element 40 is located in a cooling tower and said cooling tower is in operation with typically the pattern of various levels of U-bar fill being staggered vertically as shown in FIG. 2 and of the preferred dimensions and when there is a water flow through the tower of anywhere from 3 to 20 gal/min/ft$^2$ and an air flow crosswise through the tower of 300 to 800 ft/min., a typical splash pattern which is encountered is shown in FIGS. 6A and 6B. Thus, a splash pattern of the upper surface elements 42 and 43 are shown as FIGS. 6A and 6B. This field of splash area shown as 50 and 51 in FIGS. 6A and 6B reaches an uppermost height as compared to the other elemental splash field since as the upper elements 42 and 43 are the highest elements of the U-bar shaped fill and are composed of a flat and imperforate surface.

Another splash area defined as 53 is set up along the flat lower perforated area. A final splash area is caused by the transverse imperforated strips 47 along the lower surface element which are defined as 52 in FIGS. 6A and 6B. Thus, it can be seen that this type of U-bar shaped fill in addition to providing rigidity and use of least amount of material provides a splash pattern having three different heights so as to provide a maximum air-water contact surface. This produces a horizontal undulating air flow pattern as the air passes over each field 52 in the course of normal air transport through the tower. The undulating air pattern which is caused by the intermittent spray field 52 enhances heat transfer due to better air turbulance and greater time-of-contact between the water and air mass.

The fill bars 40 resting in the grid patterns 30 lie with their longitudinal axis essentially parallel to the air flow direction in a crossflow cooling tower, thus as this can be seen in FIG. 2, the air flow would be directly into the drawing. The splash bars 40 and holding grid structure 30 as shown present little resistance to the air flow, however, the grid structure does provide support and restraint of the splash bar fill described in the transverse and vertical direction.

Also, since the individual fill pieces 40 lie with their longitudinal axis parallel with air flow, the plurality of fill pieces dispersed in the grid structure direct the air flow in its intended path, namely parallel to the splash bars longitudinal axis and also have a tendency to direct the air in a horizontal plane through the fill assembly area. This construction aids in improving the performance when cross winds or other atmospheric disturbances are present. Similarly, because of the substantially vertical elongated elements 45 and 46, the fill bars are still able to break up water droplets should there be cross winds. If the splash bars were not so oriented, cross winds and other atmospheric disturbances would reduce the efficiency of the cooling tower.

As can be seen from FIGS. 2 and 3, the individual fill pieces can be placed in a staggered pattern. Thus, each fill member 40 is located in every other horizontal space defined by individual horizontal 33 and vertical 32 grids in the grid structure 30 but are vertically offset to adjacent fill members therebelow and immediately above so that the water directed onto a row of fill pieces 60 as shown in FIG. 2 must follow a tortuous or often oblique path before reaching the cold water basin 7 as those skilled in the art would recognize. The staggered pattern represents a preferred embodiment of the invention and it should be realized that the fill can be placed in the grid one atop each other with spaces next to each piece or for that matter every opening in the grid structure 30 can be filled with a fill member.

It should be understood, of course, that the foregoing disclosure relates only to a preferred embodiment of the invention for crossflow cooling towers and that numerous modifications or alterations such as doubling or tripling multiples of U-shaped bar fill, side-by-side interconnected may be made therein without departing from the spirit and scope of the invention as set forth in the appended claims.

What is claimed is:

1. For use with a crossflow water cooling tower having a hot water distributor for distributing water onto the splash type fill assembly structure, a cold water basin and means for inducing crossflow movement of air therebetween, a combination therewith of splash type fill assembly structure comprising, a series of elongated generally horizontal fill members;

means supporting the fill members in the space between the hot water distributor and said cold water basin in horizontal and vertical spaced relationship;

said fill members having their longitudinal axis generally parallel with the direction of air flow and said fill members having two substantially flat imperforated upper surface elements, a lower substantially flat partially imperforate element having intermittent transverse imperforate strips along its length and two vertically elongated imperforated elements one each connecting each upper surface element with the lower substantially flat element for passage and dispersal of liquid falling thereon.

2. The splash type fill assembly structure as set forth in claim 1 wherein the upper surface elements are narrow and the lower flat element is substantially wide.

3. A splash type fill assembly of claim 1 wherein there are located along the entire length of the fill members snap lock elements on the outer edges of the flat elongated upper surface elements.

4. A splash type fill assembly structure of claim 1 wherein said fill members are in relative offset relationship in said supporting means with respect to fill members thereabove or therebelow.

5. A splash type fill assembly structure of claim 1 wherein the width of the two substantially flat elongated imperforate surface elements are the same.

6. A splash type fill assembly structure of claim 1 wherein the ratio of perforate to imperforate area of the entire water encountered plan view of said fill assembly structure is approximately 33 to 67.

7. The splash type fill assembly structure of claim 1 wherein the width of the two substantially flat elongated imperforate upper surface elements is approximately $\frac{1}{2}$ inch, the width of the lower substantially flat partially imperforate element is approximately 5 to 6 inches, the width of the vertical elongated imperforate element is $\frac{3}{4}$ to $1\frac{1}{2}$ inches, the width of the intermittent transverse imperforate strips is about $\frac{1}{2}$ inch.

8. The splash type fill assembly structure of claim 1 wherein the ratio of perforate to imperforate area of only the perforated section of the lower substantially flat partially imperforate element is approximately 55 to 45.

* * * * *